US005458386A

United States Patent [19]

Buthman

[11] Patent Number: 5,458,386

[45] Date of Patent: Oct. 17, 1995

[54] GOLFBALL RETRIEVAL DEVICE

[76] Inventor: Jay E. Buthman, 262 Inverrary La., Deerfield, Ill. 60015

[21] Appl. No.: 235,380

[22] Filed: Apr. 29, 1994

[51] Int. Cl.[6] ..... A63B 47/02

[52] U.S. Cl. ..... 294/19.2; 294/66.2; 359/895

[58] Field of Search ..... 294/19.2, 66.1, 294/66.2; 359/809, 895; 114/66; 441/135

[56] References Cited

U.S. PATENT DOCUMENTS

| | | | |
|---|---|---|---|
| 678,467 | 7/1901 | Groomes . | |
| 737,844 | 9/1903 | Hubbard . | |
| 1,236,265 | 8/1917 | Casson . | |
| 1,301,534 | 4/1919 | Armstrong . | |
| 2,760,807 | 2/1955 | Watson . | |
| 2,968,208 | 1/1961 | Shaw . | |
| 3,506,332 | 4/1970 | Dewey . | |
| 3,669,427 | 6/1972 | Curtis | 294/19.2 |
| 3,843,184 | 10/1974 | Horton, III | 294/66.2 |
| 4,602,846 | 7/1986 | Karnes . | |
| 4,659,125 | 4/1987 | Chuan | 294/19.2 |
| 5,374,092 | 12/1994 | Salinas | 294/66.2 |

FOREIGN PATENT DOCUMENTS

| | | | |
|---|---|---|---|
| 577784 | 9/1924 | France | 114/66 |

*Primary Examiner*—Dean Kramer
*Attorney, Agent, or Firm*—Olson & Hierl, Ltd.

[57] ABSTRACT

A device for retrieving submerged golfballs comprising a telescoping, elongated member having a golfball scoop at one end. An underwater viewing device having a lens is secured to the elongated bar to enable a submerged golfball to be seen from outside the water when the scoop and a portion of the viewing device are submerged into the water.

23 Claims, 2 Drawing Sheets

GOLFBALL RETRIEVAL DEVICE

FIELD OF THE INVENTION

The present invention relates to a device for retrieving golfballs from ponds, rivers or the like.

BACKGROUND

Devices for retrieving golfballs submerged in golf course "water holes", i.e. ponds, rivers or the like, are heretofore known. One popular device for retrieving submerged golfballs comprises a telescoping rod or bar having a handle on one end and a golfball scoop on the other end. To retrieve a submerged golfball, the golfer extends the rod, places the scoop into the water and retrieves the submerged golfball. It also has been known to install a ring clip on the device, in place of the scoop, for gripping the submerged golfball.

Although the prior art devices have achieved popularity, the device is only effective if the golfball can be seen by the golfer from outside the water. Since the water in golf course water holes tends to be very murky and opaque, however, it is very common that the submerged golfball cannot be seen by the golfer and therefore cannot be retrieved.

Accordingly, it is an object of the present invention to provide an improved device for retrieving golfballs submerged in a golf course water hole.

It is a further object of the present invention to provide such a device that includes an underwater viewing device that enhances the golfer's ability to spot the submerged golfball.

SUMMARY

In accordance with these and other objects, a golfball retrieval device is provided in the form of an elongated member or rod having a handle on one end and a golfball scoop or other golfball gripping device on the other end. An underwater viewing device is secured to the bar. In its preferred embodiment, the viewing device comprises a hollow tube that extends parallel to the bar, defining distal and proximal ends. The distal end of the viewing device is located in close proximity to the golfball scoop and has a lens secured thereto.

To retrieve a submerged golfball, the golfer extends the elongated member the desired length. The golfer then places the scoop and distal end of the tube into the water in the vicinity of the submerged golfball, with the handle and the proximal end of the tube remaining outside the water. The golfer peers through the proximal end of the hollow tube, and spots the submerged golfball or maneuvers the elongated member until the submerged golfball can be spotted. Once it is spotted, the golfer retrieves the golfball with the scoop.

BRIEF DESCRIPTION OF THE DRAWINGS

The present invention and the advantages thereof will become more apparent upon consideration of the following detailed description when taken in conjunction with the accompanying drawings.

FIG. 3(*b*) is a cross section of a second embodiment of the lens of the present invention.

FIG. 3(*c*) is a cross section of a third embodiment of the lens of the present invention.

FIG. 3(*d*) is a cross section of a fourth embodiment of the lens of the present invention.

FIG. 3(*e*) is a cross section of a fifth embodiment of the lens of the present invention.

DETAILED DESCRIPTION OF THE PREFERRED EMBODIMENTS

Figure 1:
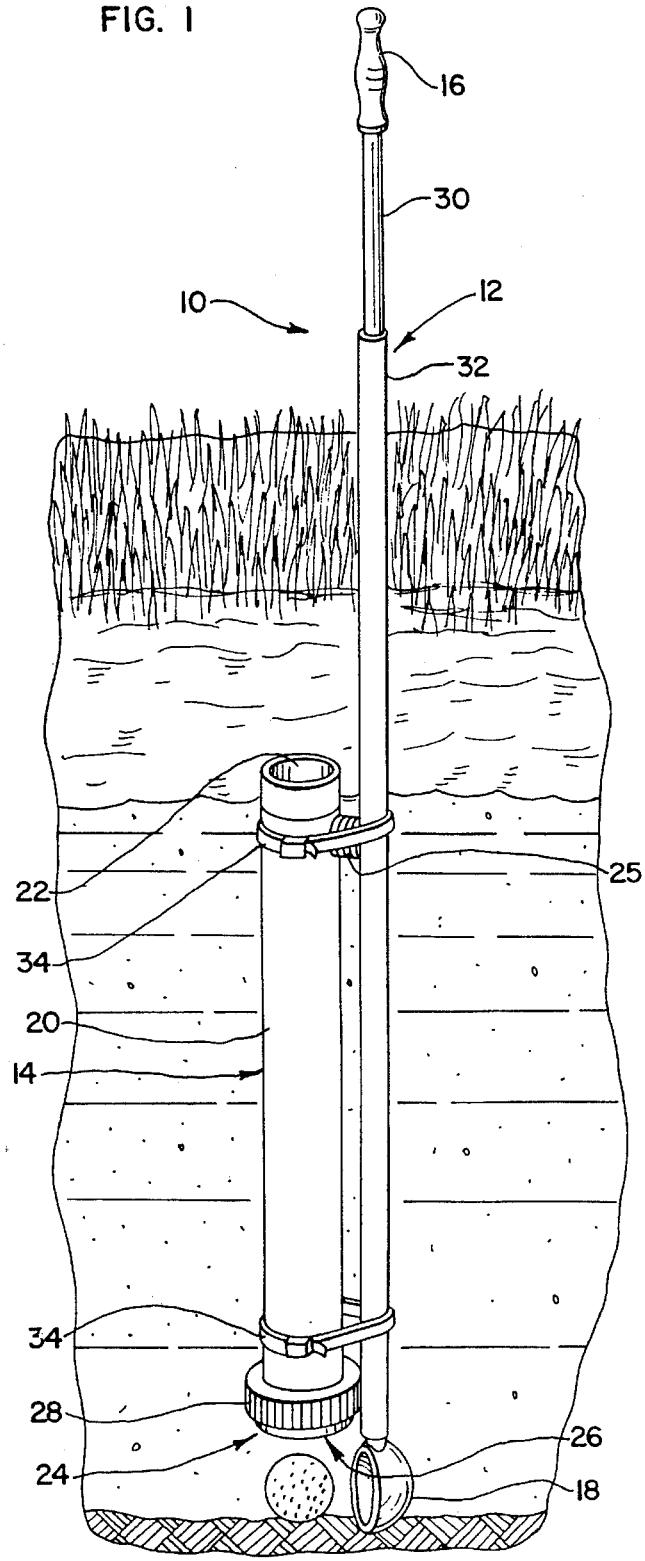
FIG. 1 comprises a perspective of a golfball retrieval device in accordance with the preferred embodiment of the invention, illustrating the scoop and a portion of the underwater viewing device submerged in the water in the vicinity of a submerged golfball.

The golfball retrieval device 10 in accordance with the preferred embodiment of the invention comprises an elongated member 12 and an underwater viewing device 14 secured thereto. The elongated member 12 comprises a handle 16 on one end and a scoop 18 on its other end. Preferably, the elongated member 12 is extendable and retractable. Scoop 18 may be of any configuration that is effective to grasp a golfball, such as the conventional scoop shown in FIG. 1. If desired, a conventional golfball ring clip 18A, as shown in FIG. 2, or any other golfball clutching means can be substituted for the scoop.

Figure 2:
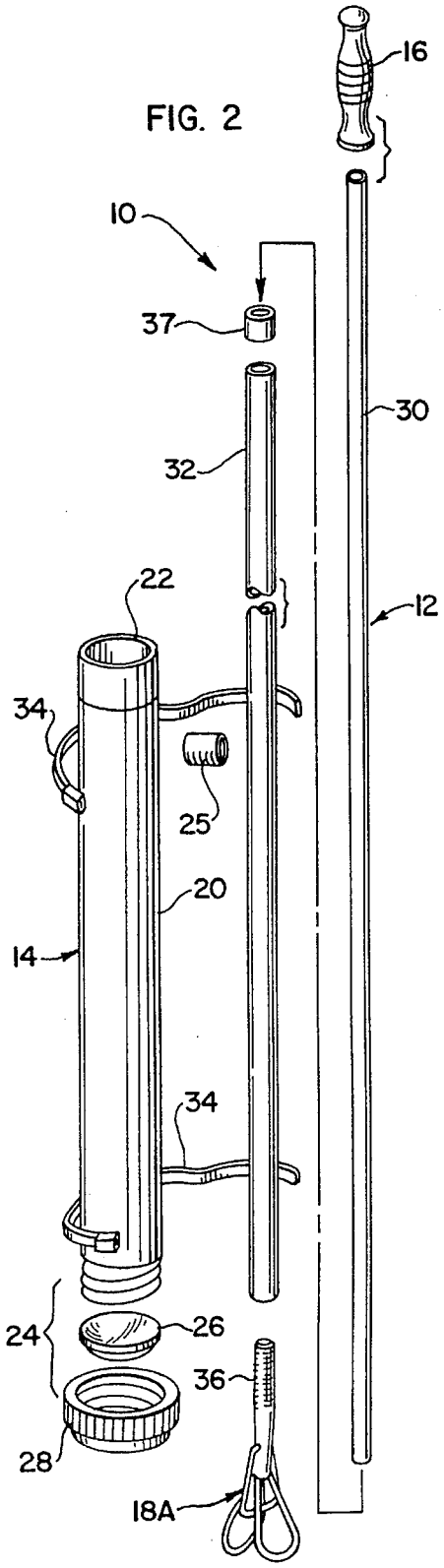
FIG. 2 is an exploded view of another embodiment of the invention wherein the lens of the viewing device is secured by a cap and a golfball ring clip is used in place of the scoop.
Figure 3A:
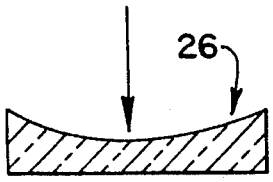
FIG. 3(*a*) is a cross section of a first embodiment of the lens of the present invention.
Figure 3B:
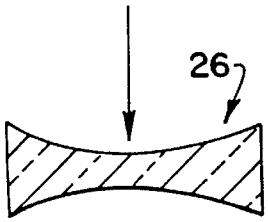
Figure 3C:
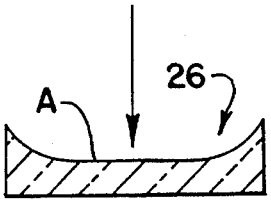
Figure 3D:
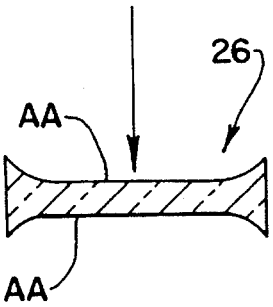
Figure 3E:
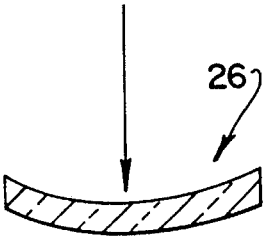

In the embodiments of FIGS. 1 and 2, the viewing device 14 comprises a hollow tube 20 that extends generally parallel to the elongated member 12, and has a proximal end 22 and a distal end 24 located in close proximity to the scoop 18. A lens 26 is secured to the distal end. The hollow tube 20 may be constructed of any suitable material that desirably is lightweight, such as, for example, poly vinyl chloride or a light weight metal.

Lens 26 preferably is a negative lens to provide a wide viewing angle beneath the surface of the water. FIGS. 3(*a*)–3(*e*) provide examples of negative lenses that can be used with the invention: FIG. 3(*a*) is a cross section of a generally plano-concave lens; FIG. 3(*b*) is a cross section of a generally double concave lens; FIG. 3(*c*) is a cross section of a generally plano-concave lens having a flat surface A formed on the curved side of the lens; FIG. 3(*d*) is a cross section of a generally double concave lens having a flat surface AA formed on each of the curved sides of the lens; and FIG. 3(*e*) is a cross section of a negative meniscus lens. The lens of FIG. 3(*a*), (*b*), (*c*), (*d*), or (*e*) is oriented so that the viewing direction is the direction of the arrows in FIGS. 3(*a*)–3(*e*).

Although the curved surfaces of the lenses of FIGS. 3(*a*)–3(*e*) are effective in increasing the viewing angle beneath the surface of the water, the curved surfaces also tend to add viewing distortion which may make it difficult to focus on the submerged golfball, especially since the water also distorts the underwater viewing. Accordingly, preferably flat surfaces are formed in the curved surfaces to enhance the golfer's ability to focus on the submerged golfball. The lenses of FIG. 3(*c*) and 3(*d*), for example, include flat surface A and flat surfaces AA, respectively. Desirably, each flat surface A or AA is generally circular and has a diameter that is substantially the same as or greater than the outer diameter of the golfball.

It is appreciated, however, that the invention is not limited to the above described lenses. For example, if desired, a flat lens or even a positive lens could instead be employed to achieve the objectives of the invention.

The lens 26 may be constructed of any transparent material such as, for example, glass or a transparent plastic, and may be secured to the hollow tube 20 in any suitable manner. For example, the lens 26 may be integral with the hollow tube 20, or may be secured to the hollow tube 20 by a cap 28 that receives the lens and threadingly engages the hollow tube, as shown best in FIG. 2. The proximal end 22 of the hollow tube may either be open or, alternatively, may be closed by a lens constructed of any transparent material.

In its preferred embodiment, the elongated member 12 comprises a first rod 30 that is telescopically received by a second rod 32. The viewing device 14 is secured to the second rod in any suitable manner, such as, for example, by a pair of spaced metal brackets or hose clamps or by a pair of cables 34, as shown in FIGS. 1 and 2. If desired, one or more rubber spacers 25 may be used between the tube 20 and the elongated member 12.

The golfball scoop 18 or ring 18A is secured to the end of the second rod in any suitable manner. In the embodiment of FIG. 2, for example, the ring 18A is mounted to a stem 36 that is threadingly received within the second rod 32. In addition, a conventional locking mechanism 37 may be provided at the proximal end of the second rod 32 adapted to releasably lock the elongated member in an extended position by twisting the first rod 30.

To retrieve a submerged golfball, the golfer extends the elongated member 12 to its desired length and inserts a portion of the retrieval device 10 into the water so that the scoop 18 (or ring 18A) and the distal end 24 of the hollow tube 20 are submerged in the vicinity of the submerged golfball. By looking through the proximal end 22 of the hollow tube, the golfer can see beneath the surface of the water and eventually spot the submerged golfball, even if the water is murky. This phenomena occurs because, among other reasons, the refraction and reflection characteristics of the water surface which affect one's ability to see beneath the surface are by-passed or at least reduced since the hollow tube 20 and lens 26 are positioned beneath the water surface. Also, the depth of murky water through which the golfer would otherwise be looking is reduced by the depth at which the lens is located. In any event, once the golfball is spotted (and then brought into better focus if the lens of FIG. 3(*c*) or 3(*d*) is employed), the golfer grasps the ball with the scoop 18 (or ring 18A).

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A device for retrieving a golfball submerged in a body of water, the device comprising:

means for clutching the golfball;

a handle for positioning the clutching means in the body of water; and means for viewing beneath the surface of the water when the clutching means is positioned in the water, one end of the viewing means adapted to extend above the surface of the water and the other end of the viewing means adapted to extend into the water.

2. The golfball retrieving device of claim 1 wherein the other end of the viewing means is in close proximity to the clutching means.

3. The golfball retrieving device of claim 2 wherein the viewing means comprises a tube secured to the handle.

4. The golfball retrieving device of claim 2 wherein a lens is secured to the other end of the viewing means.

5. The golfball retrieving device of claim 4 wherein the lens is generally plano-concave, the curved side of the lens being proximal to the flat side of the lens.

6. The golfball retrieving device of claim 5 wherein the curved side of the lens includes a flat surface.

7. The golfball retrieving device of claim 4 wherein the lens is generally double concave.

8. The golfball retrieving device of claim 7 wherein each of the curved sides of the lens includes a flat surface.

9. The golfball retrieving device of claim 1 wherein the viewing means comprises a tube that extends generally parallel to the retrieving device and has a first end in close proximity to the clutching means, and a lens secured to the first end of the tube.

10. The golfball retrieving device of claim 1 wherein the retrieving device further comprises first and second rods that are extensibly connected, the handle being secured to the first rod and the viewing means and clutching means being secured to the second rod.

11. The golfball retrieving device of claim 10 wherein the second rod telescopically receives the first rod.

12. The device of claim 1 wherein the clutching means comprises a scoop.

13. The device of claim 1 wherein the clutching means comprises a ring clip engageable with the golfball.

14. A device for retrieving golfballs submerged in a body of water, the device comprising:

an elongated member having a proximal end and a distal end;

a handle mounted to the proximal end of the elongated member;

means for clutching the golfball mounted to the distal end of the elongated member; and means for viewing beneath the surface of the water when the distal end of the elongated member is positioned in the water and one end of the viewing means extends into the water and the other end of the viewing means extends above the surface of the water, the viewing means secured to the elongated member and adapted to be used to spot a submerged golfball.

15. The golfball retrieving device of claim 14 wherein the viewing means comprises a tube extending generally parallel to the elongated member, one end of the tube being in close proximity to the clutching means.

16. The golfball retrieving device of claim 15 wherein a lens is secured to the one end of the tube.

17. The golfball retrieving device of claim 16 wherein the tube is hollow and constructed of polyvinyl chloride.

18. The golfball retrieving device of claim 16 wherein the lens is generally plano-concave, the curved side of the lens being proximal to the flat side of the lens.

19. The golfball retrieving device of claim 18 wherein the curved side of the lens includes a flat surface.

20. The golfball retrieving device of claim 16 wherein the lens is generally double concave.

21. The golfball retrieving device of claim 20 wherein each of the curved sides of the lens includes a flat surface.

22. The golfball retrieving device of claim 16 wherein the lens comprises a curved side and a flat surface formed in the curved side.

23. The golfball retrieval device of claim 14 wherein the elongated member comprises first and second rods that are extensibly connected, the first rod being telescopically received by the second rod.

* * * * *